US008874000B2

(12) United States Patent
Kim et al.

(10) Patent No.: US 8,874,000 B2
(45) Date of Patent: Oct. 28, 2014

(54) IMAGE FORMING APPARATUS INCLUDING A SHOCK ABSORBER

(75) Inventors: Tae Han Kim, Seongnam-si (KR); Yang Bae Jeon, Suwon-si (KR); Yun Ki You, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 128 days.

(21) Appl. No.: 13/540,989

(22) Filed: Jul. 3, 2012

(65) Prior Publication Data

US 2013/0014443 A1 Jan. 17, 2013

(30) Foreign Application Priority Data

Jul. 11, 2011 (KR) ..... 10-2011-0068204

(51) Int. Cl.
*G03G 15/00* (2006.01)
*G03G 21/16* (2006.01)

(52) U.S. Cl.
CPC ..... *G03G 21/1647* (2013.01); *G03G 21/1628* (2013.01)
USPC ..... 399/125

(58) Field of Classification Search
USPC ..... 399/125, 124; 347/108
See application file for complete search history.

(56) References Cited

U.S. PATENT DOCUMENTS

| | | | | |
|---|---|---|---|---|
| 4,575,223 | A | 3/1986 | Shimono et al. | |
| 5,860,044 | A | 1/1999 | Eki et al. | |
| 5,995,784 | A * | 11/1999 | Tempaku | 399/125 |
| 7,804,628 | B2 * | 9/2010 | Hashimoto et al. | 358/494 |
| 8,511,818 | B2 * | 8/2013 | Nishikawa | 347/108 |
| 8,565,662 | B2 * | 10/2013 | Choi | 399/377 |
| 2008/0181698 | A1 | 7/2008 | Andoh et al. | |

OTHER PUBLICATIONS

Extended European Search Report for European Application No. 12175604.3, mailed Nov. 30, 2012.

* cited by examiner

*Primary Examiner* — Quana M Grainger
(74) *Attorney, Agent, or Firm* — Staas & Halsey LLP

(57) ABSTRACT

An image forming apparatus includes a main body, a document board to open and close an upper side of the main body while being pivoted, and a shock absorber to reduce impact generated when the document board closes the upper side of the main body, wherein the shock absorber includes a link pivotably mounted, at a first end thereof, to the document board while guide protrusions are formed at a second end thereof, and a guide slot formed so that each guide protrusion is movable. Since the guide slot applies a pressure gradually increased from the first end side of the guide slot to the second end side thereof, to the guide protrusion, a speed of the guide protrusion and a pivoting speed of the document board are restricted below a certain speed when the upper side of the main body is closed through the document board.

16 Claims, 9 Drawing Sheets

IMAGE FORMING APPARATUS INCLUDING A SHOCK ABSORBER

CROSS-REFERENCE TO RELATED APPLICATIONS

This application claims the priority benefit of Korean Patent Application No. 10-2011-0068204 filed on Jul. 11, 2011 in the Korean Intellectual Property Office, the disclosure of which is incorporated herein by reference.

BACKGROUND

1. Field

Embodiments relate to an image forming apparatus capable of scanning an image of a document.

2. Description of the Related Art

An image forming apparatus refers to a machine for formation of an image on a printing medium. Examples of such an image forming apparatus include a scanner, a printer, a copier, a facsimile device, and a combination device integrating functions thereof.

Among the examples of the image forming apparatus, the image forming apparatus capable of scanning an image from a document includes a main body, a document board on which an optical window is arranged to scan the document while being disposed at an upper side of the main body, a document board cover pivotably mounted at the document board to selectively open and close the optical window of the document board.

When paper is jammed within the main body in the image forming apparatus, the jammed paper must be removed. For this reason, the main body is opened at an upper side thereof and the document board is pivotably mounted at the main body so as to open the upper side of the main body by pivoting the document board.

Also, the image forming apparatus includes a shock absorber to prevent generation of impact due to collision between the document board and the main body in the course of closing the upper side of the main body by pivoting of the document board.

SUMMARY

In an aspect of one or more embodiments, there is provided an image forming apparatus equipped with a shock absorber to reduce impact capable of being generated when an upper side of a main body is closed through a document board.

In an aspect of one or more embodiments, there is provided an image forming apparatus includes a main body, a document board pivotably mounted to the main body so as to open and close an upper side of the main body while being pivoted, and a shock absorber to reduce impact generated when the document board closes the upper side of the main body, wherein the shock absorber includes a link pivotably mounted, at a first end thereof, to the document board while guide protrusions are formed at a second end thereof opposed to the first end, and a guide slot formed so that each guide protrusion is movable, the guide protrusion moves from a first end side of the guide slot to a second end side thereof opposed to the first end side according to closing of the document board, and the guide slot applies a pressure, which is gradually increased upon progression from the first end side of the guide slot to the second end side thereof, to the guide protrusion.

The image forming apparatus may further include an auxiliary slot which extends in parallel with the guide slot, thereby forming an elastic support portion between the guide slot and the auxiliary slot so as to elastically support each guide protrusion, and the elastic support portion may have a width which is gradually increased upon progression from the first end side of the guide slot to the second end side thereof.

The guide slot may have a width which is gradually decreased upon progression from the first end side of the guide slot to the second end side thereof.

The guide slot may include a first guide portion arranged at the first end side to transfer a uniform pressure to each guide protrusion, and a second guide portion to apply the pressure, which is gradually increased upon progression from the first end side to the second end side, to the guide protrusion.

The image forming apparatus may further include an auxiliary slot which extends in parallel with the second guide portion, thereby forming an elastic support portion between the second guide portion and the auxiliary slot so as to elastically support each guide protrusion, and the elastic support portion may have a width which is gradually increased upon progression from the first end side of the guide slot to the second end side thereof.

The second guide portion may have a width which is gradually decreased upon progression from the first end side of the guide slot to the second end side thereof.

The guide slot may further include a stopper portion which extends in an arc shape from the second end side of the guide slot.

The image forming apparatus may further include a guide member provided with the guide slot, and at least one of the guide member and each guide protrusion may be made of an elastically deformable material.

In an aspect of one or more embodiments, there is provided an image forming apparatus includes a main body, a document board pivotably mounted, at one end thereof, to the main body so as to open and close an upper side of the main body, and a shock absorber to reduce impact generated when the document board closes the upper side of the main body, wherein the shock absorber includes a link pivotably mounted, at a first end thereof, to the document board while guide protrusions are formed at a second end thereof opposed to the first end, and a guide slot formed so that each guide protrusion is movable, the guide protrusion moves from a first end side of the guide slot to a second end side thereof opposed to the first end side according to closing of the document board, and the guide slot includes a first guide portion arranged at the first end side of the guide slot to apply a first pressure to the guide protrusion, and a second guide portion arranged at the second end side of the guide slot to apply a second pressure higher than the first pressure to the guide protrusion.

In an aspect of one or more embodiments, there is provided an image forming apparatus including a document board; and a shock absorber to reduce impact generated when movement of the document board opens and closes the image forming apparatus, wherein the shock absorber comprises a link pivotably mounted, at a first end thereof, to the document board while guide protrusions are formed at a second end thereof opposed to the first end, and a guide slot formed in a guide member so that each guide protrusion is movable in the guide slot; and the guide slot applies a pressure to the guide protrusion, which is gradually increased upon progression of the guide protrusion from one end of the guide slot to the other end of the guide slot.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
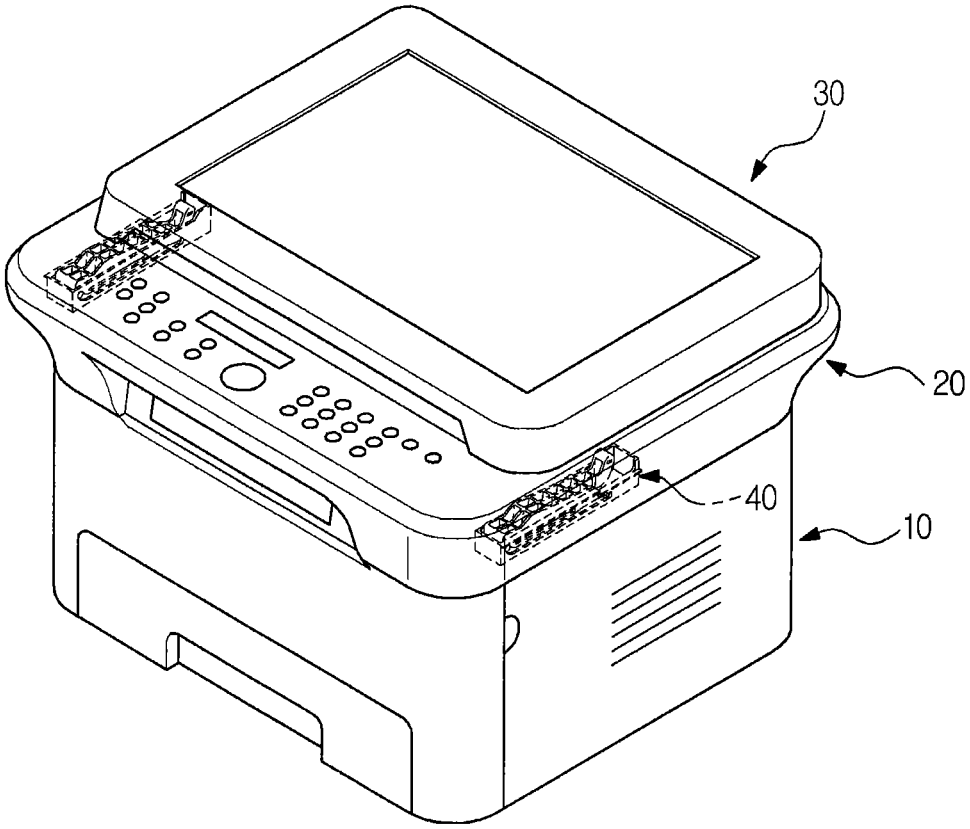
FIG. 1 is a perspective view illustrating an image forming apparatus according to an embodiment.

Reference will now be made in detail to embodiments, examples of which are illustrated in the accompanying drawings, wherein like reference numerals refer to like elements throughout.

As shown in FIG. 1, an image forming apparatus according to an embodiment includes a main body 10 defining an external appearance thereof, a document board 20 disposed at an upper side of the main body 10 and formed with an optical window (not shown) to scan a document, and a document board cover 30 pivotably mounted at the document board 20 to open and close the optical window.

The main body 10 is opened at the upper side thereof so as to remove, when paper is jammed within the main body 10, the jammed paper. The document board 20 is pivotably mounted, at one end thereof, to the main body 10 so as to open and close the upper side of the main body 10 while being pivoted.

When the upper side of the main body 10 is closed by the document board 20, the main body 10 is simultaneously affected by user's pressing force and gravity of the document board 20 at a point in time when the document board 20 closes the upper side of the main body 10, thereby increasing a pivoting speed of the document board 20. In addition, when the upper side of the main body 10 is closed by rapid pivoting of the document board 20, it may be possible to generate impact due to collision between the document board 20 and the main body 10. Accordingly, the image forming apparatus includes shock absorbers 40 to reduce the impact generated when the document board 20 closes the upper side of the main body 10.

Figure 2:
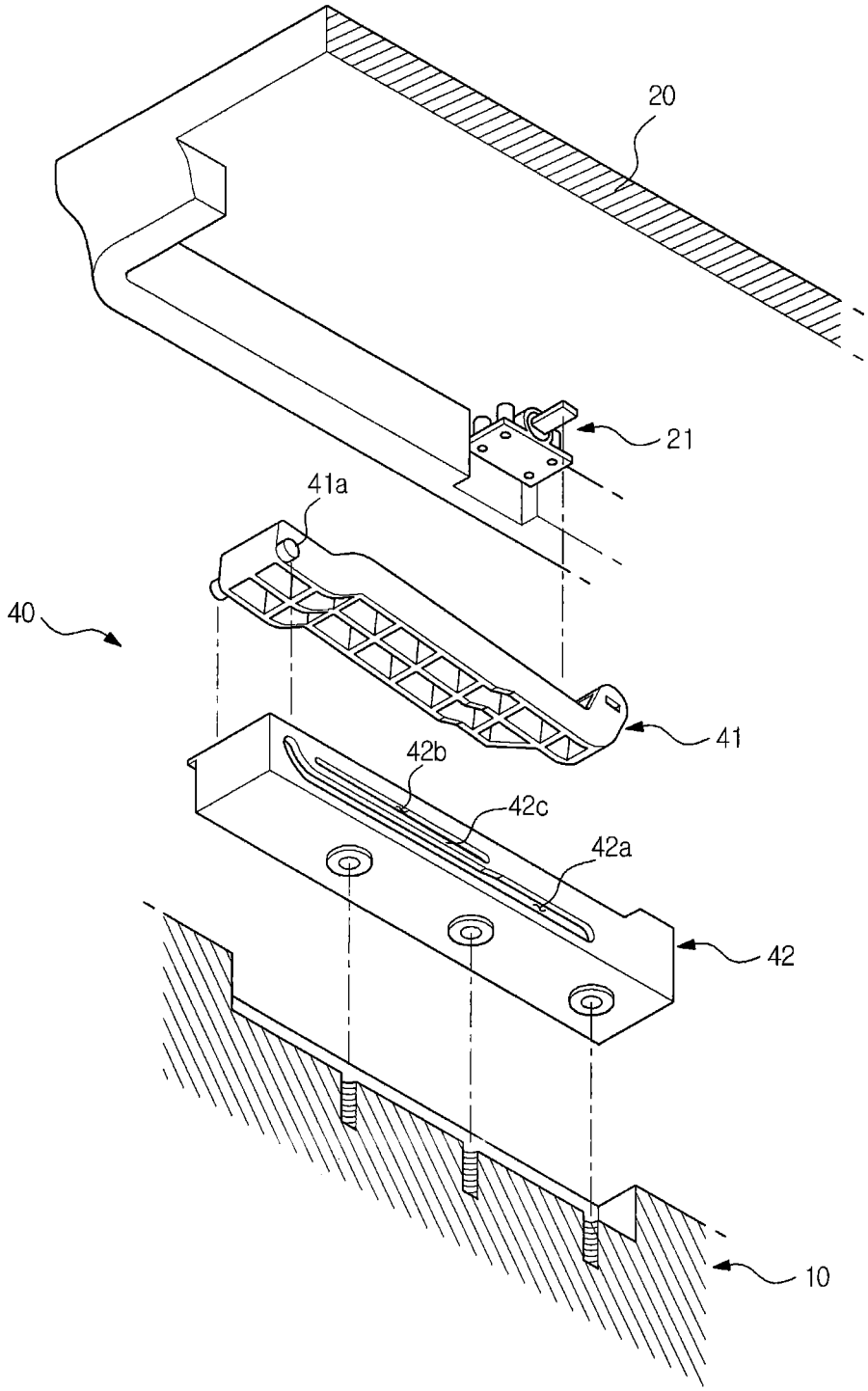
FIG. 2 is an exploded perspective view illustrating one shock absorber applied to the image forming apparatus according to an embodiment.

As shown in FIG. 2, each of the shock absorbers 40 includes a link 41 pivotably mounted, at a first end thereof, to the document board 20 while guide protrusions 41*a* bilaterally protrude at a second end thereof opposed to the first end, and a guide slot 42*a* formed so that each guide protrusion 41*a* of the link 41 is movable. The guide protrusion 41*a* moves from a first end side of the guide slot 42*a* to a second end side thereof opposed to the first end side as the document board 20 closes the upper side of the main body 10. That is, the guide protrusion 41*a* is positioned at the first end side of the guide slot 42*a* at a point in time when the document board 20 begins to close the upper side of the main body 10, while being positioned at the second end side of the guide slot 42*a* at a point in time when the document board 20 finishes closing the upper side of the main body 10.

Each guide protrusion 41*a* has a circular shape in section to be rotated within the guide slot 42*a* and is formed to have a diameter slightly greater than a width of the guide slot 42*a*. A guide member 42 is provided with the guide slot 42*a*. The link 41 and the guide member 42 are made of a resin material which is a slightly elastically deformable so as to allow the guide protrusion 41*a* having the diameter relatively greater than the width of the guide slot 42*a* to be moved within the guide slot 42*a*.

The first end of the link 41 is pivotably mounted at the document board 20 through a hinge unit 21 provided at a position spaced apart from a rotational center of the document board 20 by a determined distance. The guide slot 42*a* is horizontally arranged at the guide member 42 which is lengthily mounted at the main body 10 in a horizontal direction.

The guide slot 42*a* allows the second end side of the guide slot 42*a* to apply a relatively higher pressure to the corresponding guide protrusion 41*a*, compared with the first end side of the guide slot 42*a*. That is, the pressure applied to the guide protrusion 41*a* is higher at the point in time when the document board 20 finishes closing the upper side of the main body 10 than at the point in time when the document board 20 begins to close the upper side of the main body 10. When the guide slot 42*a* is configured as described above, a movement speed of the guide protrusion 41*a* is reduced at the point in time when the document board 20 finishes closing the upper side of the main body 10, and thus the pivoting speed of the document board 20 is reduced. In other words, it may be possible to restrict the movement speed of the guide protrusion 41*a* and the pivoting speed of the document board 20 below a certain speed. Consequently, the impact of the document board 20 on the upper side of the main body 10, which is generated at the point in time when the document board 20 finishes closing of the upper side of the main body 10, is decreased.

Figure 3:
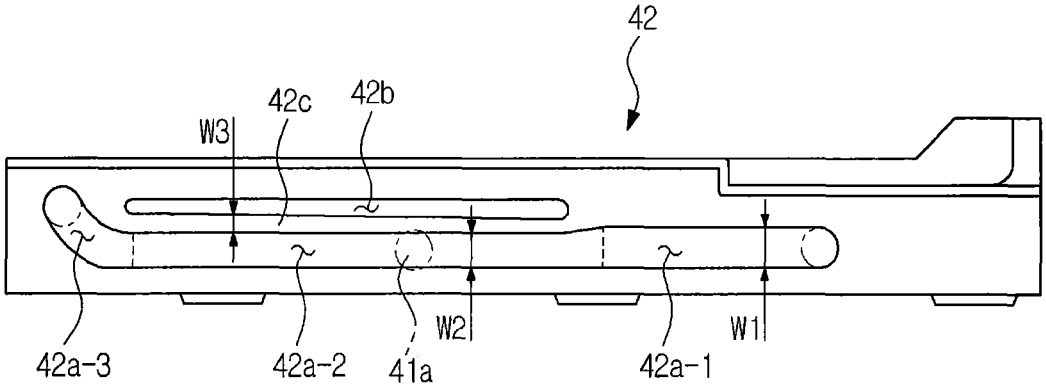
FIG. 3 is a side view illustrating one guide member applied to the image forming apparatus according to an embodiment.
Figure 4:
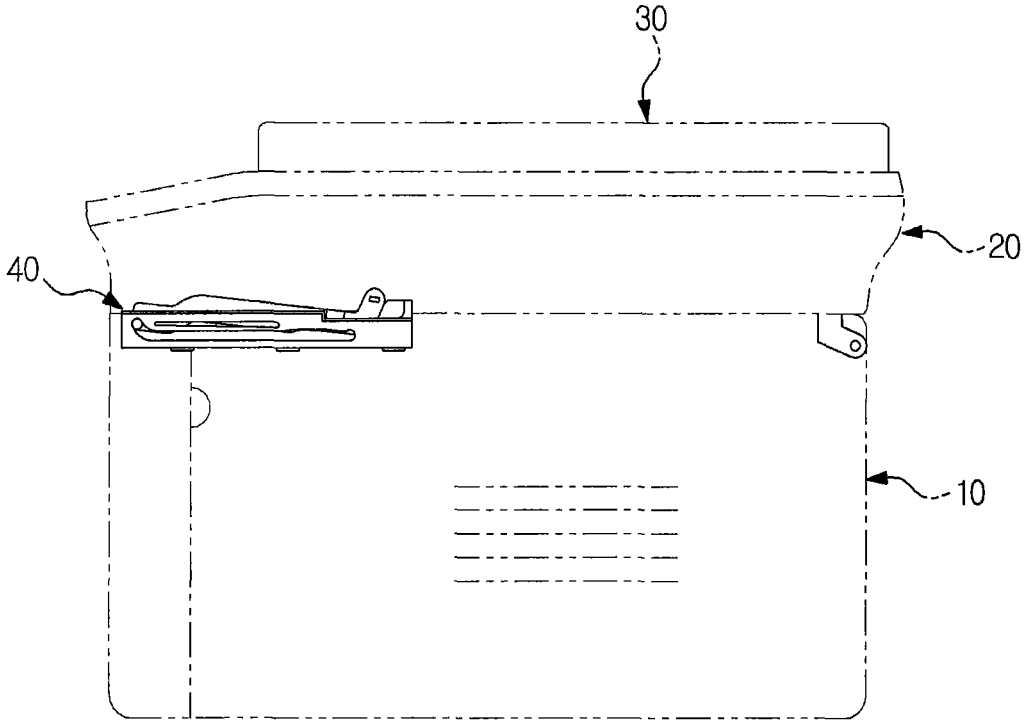
FIGS. 4 to 6 are schematic views illustrating operation of the image forming apparatus according to an embodiment.

In an embodiment, the guide slot 42*a* includes a first guide portion 42*a*-1 formed to have a first width W1 at the first end side of the guide slot 42*a* so as to apply a first pressure to the corresponding guide protrusion 41*a*, and a second guide portion 42*a*-2 formed to have a second width W2 relatively smaller than the first width W1 at the second end side of the guide slot 42*a* so as to apply a second pressure higher than the first pressure to the guide protrusion 41*a*, as shown in FIG. 3.

Also, the guide member 42 is arranged with an auxiliary slot 42*b* which extends in parallel with the second guide portion 42*a*-2 so as to correspond to the second guide portion 42*a*-2, such that an elastic support portion 42*c* is formed between the guide slot 42*a* and the auxiliary slot 42*b* so as to elastically support the guide protrusion 41*a*. The elastic support portion 42*c* has a width W3 which is gradually thicker upon progression from the first end side of the guide slot 42*a* to the second end side thereof.

As described above, the guide member 42 is made of the resin material. Thus, as the elastic support portion 42*c* arranged at the guide member 42 becomes thinner, elastic deformation thereof becomes easier, whereas as the elastic support portion 42*c* becomes thicker, elastic deformation thereof becomes more difficult. Consequently, a thin piece of the elastic support portion 42*c* applies a relatively smaller pressure to the corresponding guide protrusion 41*a*, whereas a thick piece of the elastic support portion 42*c* applies a relatively higher pressure to the guide protrusion 41*a*. Therefore, the second guide portion 42*a*-2 applies a pressure, which is gradually increased upon progression from the first end side of the guide slot 42*a* to the second end side thereof, to the guide protrusion 41*a* through the elastic support portion 42*c*.

The second end side of the guide slot 42*a* is arranged with a stopper portion 42*a*-3 in order for movement of the corresponding guide protrusion 41*a* to be stopped, thereby stopping the pivoting of the document board 20. In an embodiment, the stopper portion 42*a*-3 extends in an arc shape from the second guide portion 42*a*-2, thereby allowing force acting on the guide protrusion 41*a* to be dispersed and eliminated.

Hereinafter, the following description will given of operation of one shock absorber applied to the image forming apparatus according to an embodiment.

Figure 5:
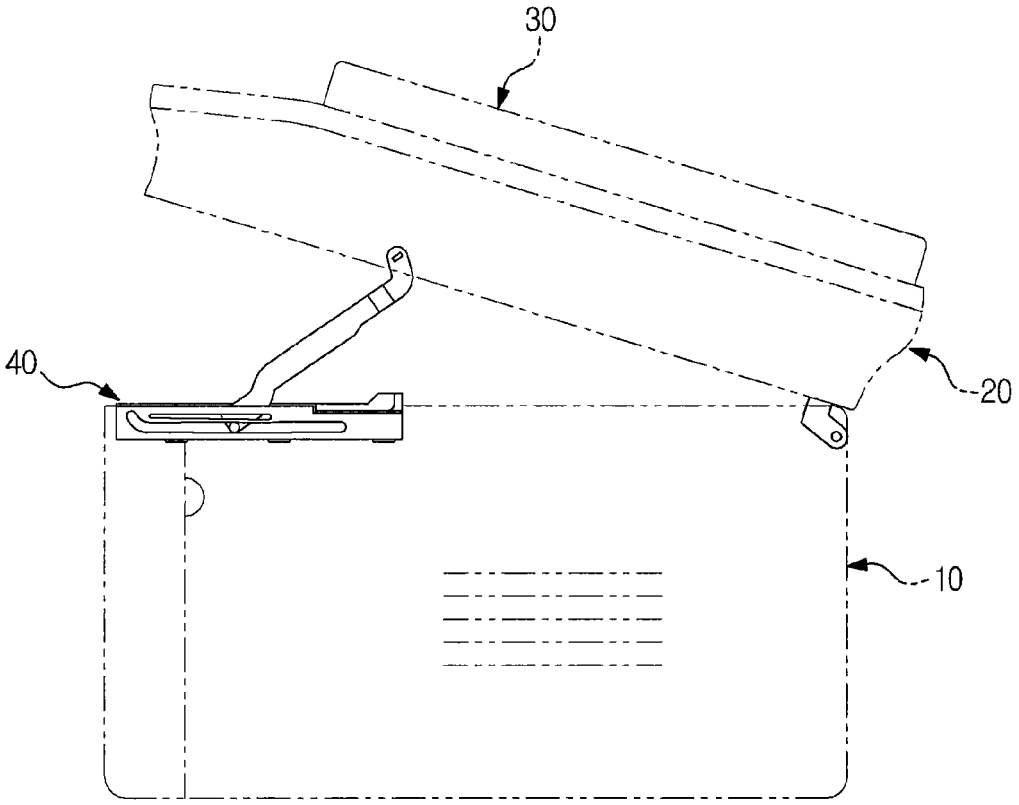
Figure 6:
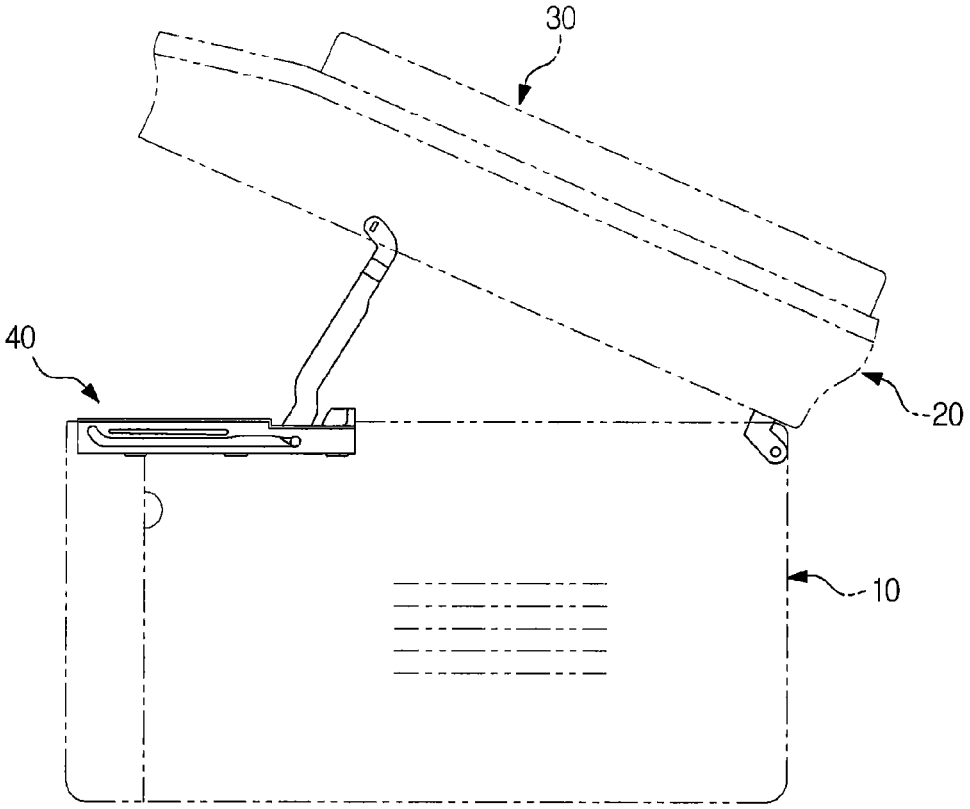

First, each guide protrusion 41*a* is positioned at an end of first end side of the guide slot 42*a* in a state in which the upper side of the main body 10 is opened, as shown in FIG. 6. In this case, when a user forcibly pivots the document board 20, the guide protrusion 41*a* is moved to the second end side of the guide slot 42*a* along the guide slot 42*a*, as shown in FIG. 5. In an embodiment, since the first guide portion 42*a*-1 is formed so as to allow the first width W1 thereof to be uniform, the first pressure applied to the guide protrusion 41*a* is uniformly maintained while the guide protrusion 41*a* moves along the first guide portion 42*a*-1.

Subsequently, when the guide protrusion 41*a* passes through the first guide portion 42*a*-1 and moves to the second guide portion 42*a*-2, the guide protrusion 41*a* is elastically supported by the elastic support portion 42*c*. As described above, the second guide portion 42*a*-2 applies the second pressure, which is gradually increased upon progression from the first end side of the guide slot 42*a* to the second end side thereof, to the guide protrusion 41*a* through the elastic support portion 42*c*, such that the movement speed of the guide protrusion 41*a* is reduced while moving along the second guide portion 42*a*-2, thereby restricting the movement speed of the guide protrusion 41*a* and the pivoting speed of the document board 20 below a certain speed.

The guide protrusion 41*a* passes through the second guide portion 42*a*-2 and moves to the stopper portion 42*a*-3. Since the stopper portion 42*a*-3 is formed in the arc shape as described above, the force acting on the guide protrusion 41*a* is dispersed through a surface of the stopper portion 42*a*-3 and is considerably eliminated. Accordingly, the movement speed of the guide protrusion 41*a* is rapidly reduced, and thus the pivoting speed of the document board 20 is rapidly reduced as well. Consequently, impact due to collision between the document board 20 and the main body 10 is nearly eliminated or is restricted at a very little level.

Figure 7:
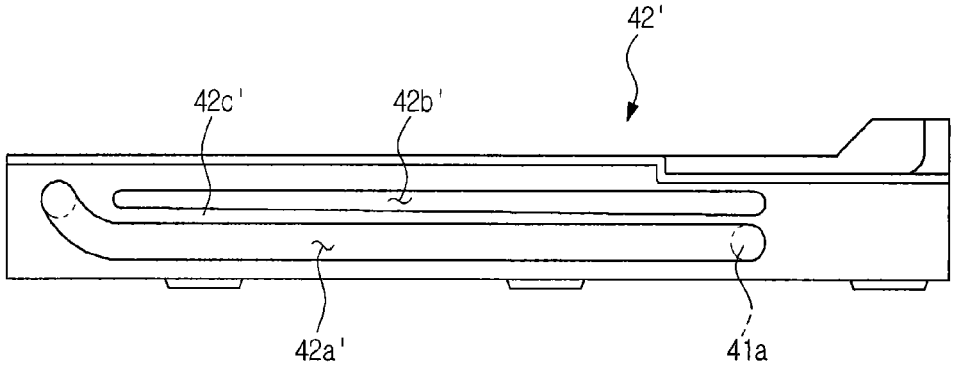
FIGS. 7 to 9 are side views illustrating one guide member applied to an image forming apparatus according to embodiments.

In an embodiment, the auxiliary slot 42*b* is formed to correspond to the second guide portion 42*a*-2 of the guide slot 42*a*. However, an embodiment is not limited thereto, and a guide member 42' may be provided with an auxiliary slot 42*b*' formed to correspond to the entirety of a guide slot 42*a*', as shown in FIG. 7. A guide protrusion 41*a*' is elastically supported by an elastic support portion 42*c*'.

Figure 8:
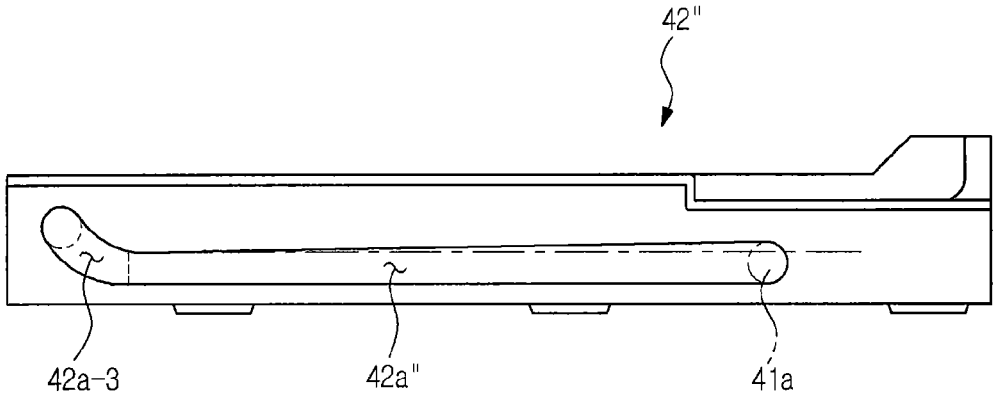

Also, a guide slot 42*a*" arranged at a guide member 42" may have a width which is gradually decreased upon progression from a first end side of the guide slot 42*a*" to a second end side thereof without the configuration corresponding to the auxiliary slot 42*b*, thereby enabling the pressure applied to the guide protrusion 41*a* to be increased, as shown in FIG. 8.

Figure 9:
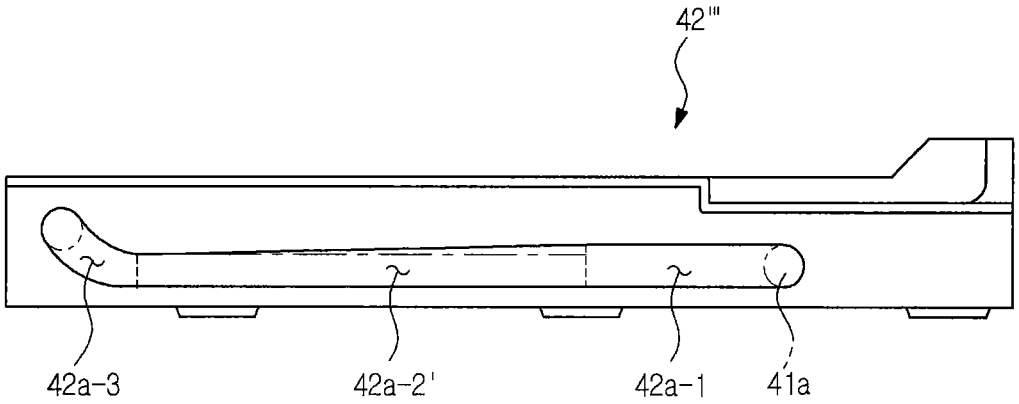

In addition, the second guide portion 42*a*-2 allows the pressure applied to the guide protrusion 41*a* to be gradually increased by gradually increasing the thickness of the elastic support portion 42*c* arranged at the auxiliary slot 42*b* in an embodiment. However, an embodiment is not limited thereto, and a second guide portion 42*a*-2' may have a width which is gradually decreased upon progression from a first end side of a guide slot 42*a*'" to a second end side thereof without the configuration corresponding to the auxiliary slot 42*b*, thereby enabling the pressure applied to the guide protrusion 41*a* to be increased, as shown in FIG. 9.

Furthermore, the guide slot 42*a* is arranged at the guide member 42 fixed to the main body 10 in an embodiment. However, an embodiment is not limited thereto, and a configuration corresponding to the guide slot may also be formed at the main body 10.

As is apparent from the above description, a pressure applied to each guide protrusion is increased through a guide slot as a document board closes an upper side of a main body, thereby restricting a movement speed of the guide protrusion and a pivoting speed of the document board. As a result, it may be possible to considerably reduce impact capable of being generated due to collision between the document board and the main body.

Also, since the collision between the document board and the main body and the impact according to the same may be reduced simply by changing a shape of the guide slot, it may be possible to prevent an increase in production costs encountered when additional parts are used.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus comprising:

a main body;

a document board pivotably mounted to the main body so as to open and close an upper side of the main body while being pivoted; and a shock absorber to reduce impact generated when the document board closes the upper side of the main body, wherein:

the shock absorber comprises a link pivotably mounted, at a first end thereof, to the document board while a guide protrusion is formed at a second end thereof opposed to the first end, and a guide slot formed so that the guide protrusion is movable, and the guide protrusion moves from a first end side of the guide slot to a second end side thereof opposed to the first end side according to closing of the document board; and the guide slot applies a pressure, which is gradually increased upon progression from the first end side of the guide slot to the second end side thereof, to the guide protrusion.

2. The image forming apparatus according to claim 1, further comprising:

an auxiliary slot which extends in parallel with the guide slot, thereby forming an elastic support portion between the guide slot and the auxiliary slot so as to elastically support the guide protrusion, wherein the elastic support portion has a width which is gradually increased upon progression from the first end side of the guide slot to the second end side thereof.

3. The image forming apparatus according to claim 1, wherein the guide slot has a width which is gradually decreased upon progression from the first end side of the guide slot to the second end side thereof.

4. The image forming apparatus according to claim 1, wherein:

the guide slot comprises a first guide portion arranged at the first end side to transfer a uniform pressure to the guide protrusion, and a second guide portion to apply the pressure, which is gradually increased upon progression from the first end side to the second end side, to the guide protrusion.

5. The image forming apparatus according to claim 4, further comprising:

an auxiliary slot which extends in parallel with the second guide portion, thereby forming an elastic support portion between the second guide portion and the auxiliary slot so as to elastically support the guide protrusion, wherein the elastic support portion has a width which is gradually increased upon progression from the first end side of the guide slot to the second end side thereof.

6. The image forming apparatus according to claim 4, wherein the second guide portion has a width which is gradually decreased upon progression from the first end side of the guide slot to the second end side thereof.

7. The image forming apparatus according to claim 1, wherein the guide slot further comprises a stopper portion which extends in an arc shape from the second end side of the guide slot.

8. The image forming apparatus according to claim 1, further comprising a guide member provided with the guide slot, wherein at least one of the guide member and the guide protrusion is made of an elastically deformable material.

9. An image forming apparatus comprising:

a main body;

a document board pivotably mounted, at one end thereof, to the main body so as to open and close an upper side of the main body; and a shock absorber to reduce impact generated when the document board closes the upper side of the main body, wherein:

the shock absorber comprises a link pivotably mounted, at a first end thereof, to the document board while a guide protrusion is formed at a second end thereof opposed to the first end, and a guide slot formed so that the guide protrusion is movable, and the guide protrusion moves from a first end side of the guide slot to a second end side thereof opposed to the first end side according to closing of the document board; and the guide slot comprises a first guide portion arranged at the first end side of the guide slot to apply a first pressure to the guide protrusion, and a second guide portion arranged at the second end side of the guide slot to apply a second pressure higher than the first pressure to the guide protrusion.

10. The image forming apparatus according to claim 9, wherein the first guide portion applies a uniform pressure to the guide protrusion.

11. The image forming apparatus according to claim 9, wherein the second guide portion applies a pressure, which is gradually increased upon progression from the first end side of the guide slot to the second end side thereof, to the guide protrusion.

12. The image forming apparatus according to claim 11, further comprising:

an auxiliary slot which extends in parallel with the second guide portion, thereby forming an elastic support portion between the second guide portion and the auxiliary slot so as to elastically support the guide protrusion, wherein the elastic support portion has a width which is gradually increased upon progression from the first end side of the guide slot to the second end side thereof.

13. The image forming apparatus according to claim 11, wherein the second guide portion has a width which is gradually decreased upon progression from the first end side of the guide slot to the second end side thereof.

14. The image forming apparatus according to claim 9, wherein the guide slot further comprises a stopper portion which extends in an arc shape from the second end side of the guide slot.

15. The image forming apparatus according to claim 9, further comprising a guide member provided with the guide slot, wherein at least one of the guide member, the first guide portion and the second guide portion is made of an elastically deformable material.

16. An image forming apparatus comprising:

a document board; and a shock absorber to reduce impact generated when movement of the document board opens and closes the image forming apparatus, wherein:

the shock absorber comprises a link pivotably mounted, at a first end thereof, to the document board while a guide protrusion is formed at a second end thereof opposed to the first end, and a guide slot formed in a guide member so that the guide protrusion is movable in the guide slot; and the guide slot applies a pressure to the guide protrusion, which is gradually increased upon progression of the guide protrusion from one end of the guide slot to the other end of the guide slot.

* * * * *